US005786038A

United States Patent [19]

Conley et al.

[11] Patent Number: 5,786,038

[45] Date of Patent: *Jul. 28, 1998

[54] SYNTHETIC DIAMOND LAYERS HAVING WEAR RESISTANT COATINGS FORMED IN SITU AND METHODS OF APPLYING SUCH COATINGS

[76] Inventors: James G. Conley, 443 Jefferson Ave., Glencoe, Ill. 60022; Jerome H. Lemelson, 868 Tyler Way, Incline Village, Nev. 89540

[ * ] Notice: The term of this patent shall not extend beyond the expiration date of Pat. No. 5,616,372.

[21] Appl. No.: 829,761

[22] Filed: Mar. 31, 1997

Related U.S. Application Data

[63] Continuation of Ser. No. 475,874, Jun. 7, 1995, Pat. No. 5,616,372.

[51] Int. Cl.[6] ..... B05D 3/06

[52] U.S. Cl. ..... 427/554; 427/596; 427/249; 427/122; 427/402

[58] Field of Search ..... 427/554, 596, 427/249, 122, 402; 423/446

[56] References Cited

U.S. PATENT DOCUMENTS 4,734,339 3/1988 Schachner et al. ..... 428/701

FOREIGN PATENT DOCUMENTS 6-148908 5/1994 Japan .

OTHER PUBLICATIONS

Kawarada et al. Appl. Phys. lett. 66(5), Jan. 1995, pp. 583–585.

*Primary Examiner*—Roy V. King
*Attorney, Agent, or Firm*—Niro, Scavone, Haller & Niro

[57] ABSTRACT

This invention discloses methods of making new and improved diamond coatings bonded to substrates, in which the coatings are protected by post-deposition treatment to form graphite-based lubricating constituents in situ, as well as articles of manufacture made using such techniques.

3 Claims, No Drawings

SYNTHETIC DIAMOND LAYERS HAVING WEAR RESISTANT COATINGS FORMED IN SITU AND METHODS OF APPLYING SUCH COATINGS

This is a continuation application Ser. No. 08/475,874 filed on Jun. 7, 1995, now U.S. Pat. No. 5,616,372.

BACKGROUND OF THE INVENTION

FIELD OF THE INVENTION

This invention relates to methods of making new and improved diamond coatings bonded to substrates, in which the coatings are protected by post-deposition treatment to form lubricating constituents in situ.

BACKGROUND OF THE INVENTION

Diamond, diamond-like carbon and diamond-like hydrocarbon coatings have been employed both to provide hard faces on engineered materials and as abrasive coatings on articles made from such materials. Typically such diamond films and/or particles are applied using some form of chemical vapor deposition (CVD) process. Such processes generally use thermal decomposition of a mixture of hydrogen and carbon compounds, preferably hydrocarbons, into diamond generating carbon atoms preferentially from the gas phase activated in such a way as to avoid substantially the deposition of graphitic carbon. The specific types of carbon compounds useful for CVD include C1–C4 saturated hydrocarbons such as methane, ethane, propane and butane; C1–C4 unsaturated hydrocarbons such as acetylene, ethylene, propylene and butylene; gases containing C and such as carbon monoxide and carbon dioxide; aromatic compounds such as benzene, toluene, xylene, and the like; and organic compounds containing C, H, and at least one of oxygen and/or nitrogen such as methanol, ethanol, propanol, dimethyl ether, diethyl ether, methylamine, ethylamine, acetone, and similar materials (see U.S. Pat. No. 4,816,286). The concentration of carbon compounds in the hydrogen gas can vary from about 0.1% to about 5%, preferably from about 0.2% to 3%, and more preferably from about 0.5% to 2%. The resulting diamond film in such a deposition method is in the form of adherent individual crystallites or a layer-like agglomerates of crystallites substantially free from intercrystalline adhesion binder.

Such CVD processes are known to those skilled in the art, and ordinarily use some form of energy (for example, microwave radiation, as in U.S. Pat. No. 4,859,493 and in U.S. Pat. No. 434,188) to pyrolyze hydrocarbon gases such as methane at concentrations of about 1% to 2% in a low pressure (about 10 torr) hydrogen atmosphere, causing deposition of diamond or "diamond-like carbon"(a-C) or "diamond-like hydrocarbon" (a-C:H) particles or film on a nearby substrate. (Diamond and "diamond-like carbon" (a-C) coatings have an atomic hydrogen fraction of zero; for "diamond-like hydrocarbon" (a-C:H) coatings that fraction ranges from about 0.15 to about 0.6. Diamond coatings have atom number densities around 0.29 gram-atoms per cubic centimeter; "diamond-like carbon" (a-C) and "diamond-like hydrocarbon" (a-C:H) materials are characterized by atom number densities above 0.19 gram-atoms per cc.) It is also known to assist the CVD process using a variety of techniques including (1) pyrolysis by a hot tungsten filament intended to generate atomic hydrogen near the substrate (HFCVD) (2) supplying electrons by negatively biasing the filament as in electron-assisted chemical vapor deposition (EACVD); (3) creating a plasma using microwave energy or RF energy (PACVD; see U.S. Pat. Nos. 4,504,519 and 5,382,293); (4) using an argon ion beam to decompose the hydrocarbon feedstock, as in U.S. Pat. No. 4,490,229 and (5) using direct-current electrical discharge methods. See, generally, John C. Angus and Cliff C. Hayman, "Low-Pressure, Metastable Growth of Diamond and 'Diamond-like' Phases," *Science*, Aug. 19, 1988, at p. 913. The disclosures of the U.S. patent references cited above are incorporated by reference herein.

The ion beam deposition method typically involves producing carbon ions by heating a filament and accelerating carbon ions to selected energies for deposit on a substrate in a high vacuum environment. Ion beam systems use differential pumping and mass separation techniques to reduce the level of impurities in the carbon ion flow to the growing film.

The chemical vapor deposition and plasma enhanced chemical vapor deposition methods are similar in operation. Both methods use the dissociation of organic vapors (such as $CH_3OH$, $C_2H_2$, and $CH_3OHCH_3$) to produce both carbon ions and neutral atoms of carbon for deposit on a substrate. Plasma enhanced methods are described in U.S. Pat. Nos. 5,382,293 and No. 5,403,399, the disclosures of which are incorporated by reference herein.

It is also known to apply polycrystalline diamond layers using sintering at simultaneous high pressures (50 kbar) and temperatures (1300° C.) to create conditions under which the diamond phase is thermodynamically stable, as in U.S. Pat. No. 5,370,195. And liquid-phase diffusion metallizing techniques also have been suggested for bonding diamond to certain types of substrates, as in U.S. Pat. No. 5,392,982.

Synthetic diamond-coated articles have found a wide variety of uses. U.S. Pat. No. 4,960,643, for example, discloses articles coated with synthetic diamond particles of controlled size, to which an overlying film, for example of chromium, has been applied to help the diamond layer resist scratching and wear. Other patents disclose various diamond-coated articles of manufacture, including bearings (U.S. Pat. No. 5,284,394); fasteners (U.S. Pat. No. 5,096,352); engine parts (U.S. Pat. Nos. 5,132,587 and 4,974,498) and the like.

It is known that the durability and frictional properties of diamond-coated engineered materials can be improved by applying coatings such as chromium over the diamond film (see, e.g., U.S. Pat. Nos. 4,960,643; No. 5,346,719 and No. 5,224,969), and that excess non-diamond carbon mixed with diamond in a matrix can improve wear resistance, as disclosed in U.S. Pat. No. 5,158,148. In the past, however, such coatings or matrices have been applied to diamond substrates (such as diamond particles in drill bit inserts and the like) by a multi-step process involving MVD or CVD creation of metal or carbide films on the surface of the diamond particles or by adding excess carbon during high pressure sintering.

SUMMARY OF THE INVENTION

We find that the wear resistance and frictional properties of diamond, diamond-like carbon and diamond-like hydrocarbon thin film coatings applied to metal, cermet and ceramic substrates can be improved by applying a non-diamond graphite coating over the diamond coating, and then post-treating the non-diamond graphite coating by laser ablation or other suitable technique at room temperature to create a mixture of $sp^3$ diamond particles and lubricating graphite at the surface.

Accordingly, it is an object of this invention to provide composite engineered materials having a diamond coating applied by CVD techniques in which a non-diamond graphite coating has been applied over the diamond coating, and then post-treated by laser photo-ablation or other suitable technique at room temperature to create a mixture of $sp^3$ diamond particles and lubricating graphite at the surface.

It is a further object of this invention to provide articles of manufacture having such coatings, including fasteners; bearings; cutting tools; valve seats; gears; blades; drill bits; dies and the like—in fact, any article on which hard facing having improved wear resistance and frictional properties is desired.

Further objects of this invention will be apparent to those skilled in the arts to which it pertains from the following detailed description.

DETAILED DESCRIPTION OF THE INVENTION

To manufacture diamond-coated articles using this embodiment of our invention, an article machined, cast or otherwise fabricated of the desired substrate is first coated with diamond. The techniques disclosed in our co-pending application filed on even date and entitled "SYNTHETIC DIAMOND COATINGS WITH INTERMEDIATE BONDING LAYERS AND METHODS OF APPLYING SUCH COATINGS," may be used. The disclosure of that application is incorporated by reference herein. The use of an intermediate bonding layer, such as SiC, is optional. The total thickness of the starting diamond film is at least about 0.5 micro-meters, and preferably at least about 1.0 micro-meters.

We find that an outer coating having desirable lubrication and wear resistance properties preferably can be fabricated using laser photo-ablation techniques, although other methods of applying an outer coating also could be used. The following illustration is based on laser photo-ablation.

Starting with a diamond substrate or a diamond film that has been coated on a non-diamond substrate (with or without the use of an intermediate layer), the following process steps are conducted. First, a thin layer (preferably about 2 to about 10 micro-meters) of non-diamond graphite as applied to the diamond layer using CVD, laser photo-ablation of a graphite target, or other suitable technique. (A polymer such as polymethymethacrylate or polystyrene also can be used as a source of ions, as in U.S. Pat. No. 5,368,361.) In laser ablation, laser radiation is focused on a graphite target inside a vacuum chamber to ablate the material and ionize a portion of the ablation plume. An electrically charged accelerating grid within the vacuum chamber is used to extract ions from the plume and accelerate them toward the target upon which the film (which may constitute graphite or diamond-like carbon) is to be deposited, as described in U.S. Pat. No. 5,401,543.

In our invention, the graphite layer on the diamond substrate or diamond layer is then exposed to laser radiation, resulting in preferential photo-ablation of the graphite as a result of the fact that its absorptivity is much higher than that of diamond. Preferably wavelengths appreciably greater than the 200 nm that corresponds to the 5.2 eV optical band gap of diamond (see U.S. Pat. No. 5,366,556) should be used for this step, in order to avoid excessive ablation of the diamond layer itself. A wavelength of about 308 nm is most preferred.

The resulting wear-resistant mixed coating comprises partially-exposed diamond particles or nodules characterized by strong, directed a bonds using hybrid $sp^3$ orbitals in a matrix of graphite or amorphous (glassy) carbon. In use, for example as part of an abrasive article or cutting surface, the diamond particles provide hardness while the graphite matrix contributes to wear resistance and reduces residual stress.

It will be apparent to those of ordinary skill in the art that many changes and modifications could be made while remaining within the scope of our invention. We intend to cover all such equivalent articles of manufacture and processing methods, and to limit our invention only as specifically delineated in the following claims.

We claim:

1. A process for applying a wear-resistant diamond coating to a substrate comprising:
   a. depositing over said substrate an intermediate layer;
   b. depositing over said intermediate layer an outer diamond layer;
   c. applying a thin layer of graphite over said diamond layer; and
   d. treating said layer of graphite after its deposition by laser radiation to partially ablate said graphite to create partially-exposed $sp^3$ diamond particles in a matrix of graphite or amorphous carbon, thereby leaving an outer diamond/graphite layer having superior lubrication and wear resistance in comparison with a diamond layer alone.

2. The process of claims 1 wherein said intermediate layer is SiC.

3. A process for applying a wear-resistant diamond coating to a substrate comprising:
   a. depositing over said substrate an amorphous intermediate layer;
   b. depositing over said amorphous intermediate layer an outer diamond layer;
   c. applying a thin layer of graphite over said diamond layer; and
   d. treating said layer of graphite after its deposition by laser radiation to partially ablate said graphite to create partially-exposed $sp^3$ diamond particles in a matrix of graphite or amorphous carbon, therby leaving an outer diamond/graphite layer having superior lubrication and wear resistance in comparison with a diamond layer alone.

* * * * *